United States Patent [19]

Teague et al.

[11] Patent Number: 4,688,750

[45] Date of Patent: Aug. 25, 1987

[54] COMPONENT MOUNTING SYSTEM FOR PREFABRICATED WALLS AND THE LIKE

[75] Inventors: Terry S. Teague, Blue Springs; Donald A. Jackson, Kansas City; James L. Kerske, Lee's Summit; Stephen R. Nichols, Gladstone; Robert L. McGuire, Kansas City, all of Mo.

[73] Assignee: Glen O'Brien Movable Partition Company, Inc., Kansas City, Mo.

[21] Appl. No.: 825,261

[22] Filed: Feb. 3, 1986

[51] Int. Cl.[4] ..... A47G 29/02

[52] U.S. Cl. ..... 248/243; 52/36; 248/247

[58] Field of Search ..... 52/36; 248/243, 246, 248/247, 242; 211/87, 182, 191, 190, 192; 108/108, 109

[56] References Cited

U.S. PATENT DOCUMENTS

| | | | |
|---|---|---|---|
| Re. 28,408 | 5/1975 | Nelsson . | |
| 2,580,334 | 12/1951 | Vanderveld . . | |
| 2,928,512 | 3/1960 | Slater et al. . | |
| 3,066,774 | 12/1962 | Dahme . | |
| 3,693,556 | 9/1972 | Rous . | |
| 3,712,015 | 1/1973 | Nelsson . | |
| 3,759,297 | 9/1973 | Anderson | 248/243 |
| 3,779,499 | 12/1973 | Shell . | |
| 4,027,453 | 6/1977 | Bridge . | |
| 4,098,480 | 7/1978 | Neumann . | |
| 4,102,089 | 7/1978 | Paisley . | |
| 4,270,821 | 6/1981 | Verdesca . | |
| 4,274,687 | 6/1981 | Bayles et al. . | |
| 4,441,300 | 4/1984 | Varon et al. . | |
| 4,515,494 | 5/1985 | Robilliard et al. . | |

*Primary Examiner*—John E. Murtagh

*Attorney, Agent, or Firm*—Litman, Day & McMahon

[57] ABSTRACT

A system for mounting a component on a wall and the like includes inner and outer brackets adapted for attachment to the wall. Each bracket includes a leg positioned outwardly from the wall and an end. An upper and a lower bracket are provided for mounting a standard, and a pair of standards are provided for mounting the component. Each standard includes end plates with end flanges extending therefrom. The standard end flanges are adapted for placement between the bracket ends and the wall with the bracket ends captured between the standard faceplate and end flanges. The standards may be mounted on the wall in sets for juxtaposed mounting of standards and components. The lateral positioning of the standards on the brackets is adjustable for accommodating different components.

22 Claims, 6 Drawing Figures

COMPONENT MOUNTING SYSTEM FOR PREFABRICATED WALLS AND THE LIKE

BACKGROUND OF THE INVENTION

1. Field of the Invention.

The present invention relates generally to structural support systems, and particularly to a system for mounting compartments, shelves, bulletin boards and work surfaces on prefabricated walls and the like.

2. Description of the Prior Art.

Prefabricated or pre-engineered walls are well known in the construction industry and are extensively used in commercial, institutional and industrial buildings. Relatively low (i.e. about four to five feet high) walls are referred to in the industry as "partitions" and are commonly specified for "open" office plans wherein work stations or cubicles are provided with a certain measure of visual and acoustical privacy. For greater privacy, floor-to-ceiling prefabricated walls are available and may be used to create private offices which offer most of the amenities available in offices with site-built permanent walls. Such amenities include insulation for sound control, doors, and glass panels.

Prefabricated walls are popular with many building owners and tenants because they offer several advantages over conventional, site-built permanent walls. For example, the former are often less expensive because installation is generally handled by a single supplier or subcontractor whereas construction of site-built walls generally requires the coordination of several building trades. Prefabrication of the walls often allows them to be installed without interrupting or interfering with normal business activities. Initial erection time tends to be less with prefabricated walls than with site-built, permanent walls because the latter must be constructed on the job site from raw building materials. Furthermore, a variety of durable finishes requiring little or no maintenance may be applied to prefabricated walls at the factory. Prefabricated walls qualify for investment tax credit and accelerated depreciation under the tax laws, which result in further life-cycle cost advantages over site-built permanent walls.

The initial advantages of prefabricated walls are also applicable when they are rearranged in different configurations. As much as 90% to 100% of the materials in prefabricated walls are typically reusable, as compared with practically none of the materials in conventional wall systems.

The availability of various wall-mounted furniture components for prefabricated walls comprises yet another advantage over their site-built counterparts, and relates directly to the present invention. Such components include work surfaces, shelving, storage cabinets, bulletin boards and the like.

Prefabricated walls typically comprise vertical metal (e.g. extruded aluminum) studs with panels extending therebetween. The panels may be covered with vinyl, cloth or a variety of other materials. Glass panels and doors may also be provided between the studs.

The studs are also commonly employed for supporting the wall-hung furniture components. Regularly-spaced slots are typically provided in the studs or retainers connected thereto for this purpose. The components are mounted on the studs or retainers with inwardly-extending hooks or tabs which are received in the slots. Thus, the furniture components cantilever forwardly from the prefabricated walls that they are mounted on.

Presently, many of the leading manufacturers of prefabricated walls also manufacture their own wall-mounted components. Since most of the prefabricated wall manufacturers try to sell their customers complete installations including both walls and wall-hung components therefor, there is little or no incentive to standardize the component mounting arrangements so that the components of different manufacturers could be interchanged with the various walls. Thus, there are presently available walls and components from such major manufacturers as Glen O'Brien, Herman Miller, Haworth, Westinghouse, G. F. Furniture Systems, Steelcase, and Hauserman, each of which has its own configuration of tabs and slots for mounting the components. For example, the horizontal spacing between the slots and the vertical standards varies from 40 inches (G. F. Furniture Systems) to 47 11/16 inches (Herman Miller). Furthermore, the different manufactuers space their slots at vertical intervals ranging from 1 inch to 1½ inches. Even the thickness of the tabs is not standardized.

Thus, in view of the aforementioned variable factors relating to the wsalls and components of major manufacturers, heretofore interchangeability has not been practical, even though many customers might prefer to select the best walls and components for their particular applications regardless of source. Cost savings might thus be realized by obtaining price quotations on walls and individual components and choosing the least expensive bids for all of the times required. For example, one manufacturer might be chosen for its superior walls and another for the wall-mounted components. Furthermore, prior to the availability of the present invention, it was impractical to upgrade or add to an existing installation except with the wall-mounted components of the original supplier, which thus had little incentive to competitively price its products for its "captive" customer.

Heretofore, there has not been available a system for mounting the components of various manufacturers on prefabricated walls with the advantageous and features of the present invention.

SUMMARY OF THE INVENTION

In the practice of the present invention, a system is provided for mounting components on prefabricated walls having studs with panels extending therebetween. The panels may be secured by retainers attached to the studs or, in a another type of prefabricated wall, the panels may be secured in place by the studs themselves. The studs or retainers include outwardly-open channels. The mounting system includes inner and outer brackets which are adapted for mounting singly or in pairs to the retainers or studs in the channels thereof. One pair each of the inner and outer brackets are required to mount a component. A pair of standard are each mounted on a respective upper and lower bracket in spaced relation. The standards include slots which are adapted to receive hooks extending from the back of the component. A variety of standards may be provided with their slots positioned to accomodate the component hooks of the different furniture component manufacturers. Furthermore, the position of each standard on its mounting brackets is laterally adjustable. Thus, by selecting a pair of standards with the proper slot configuration and properly positioning them on the mounting brackets with the correct spacing between the slots, the wall-mounted furniture components of most of the major manufacturers can be accomodated on various prefabricated walls.

PRINCIPAL OBJECTS OF THE INVENTION

The principal objects of the present invention are: to provide a system for mounting components on prefabricated walls and the like; to provide such a system which is adapted to securely mount shelves, work surfaces, bulletin boards and storage cabinets on prefabricated walls; to provide such a system which allows the components of various manufacturers to be mounted on prefabricated walls; to provide such a system which utilizes a hook-and-slot mounting system for components; to provide such a system wherein standards are provided for accommodating the components of various manufacturers; to provide such a system wherein universal mounting brackets are provided for the standards; to provide such a system wherein only two types of brackets are required; to provide such a system wherein the components are securely mounted to the wall partitions; to provide such a system wherein additional support can be provided for work surfaces; and to provide such a system which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
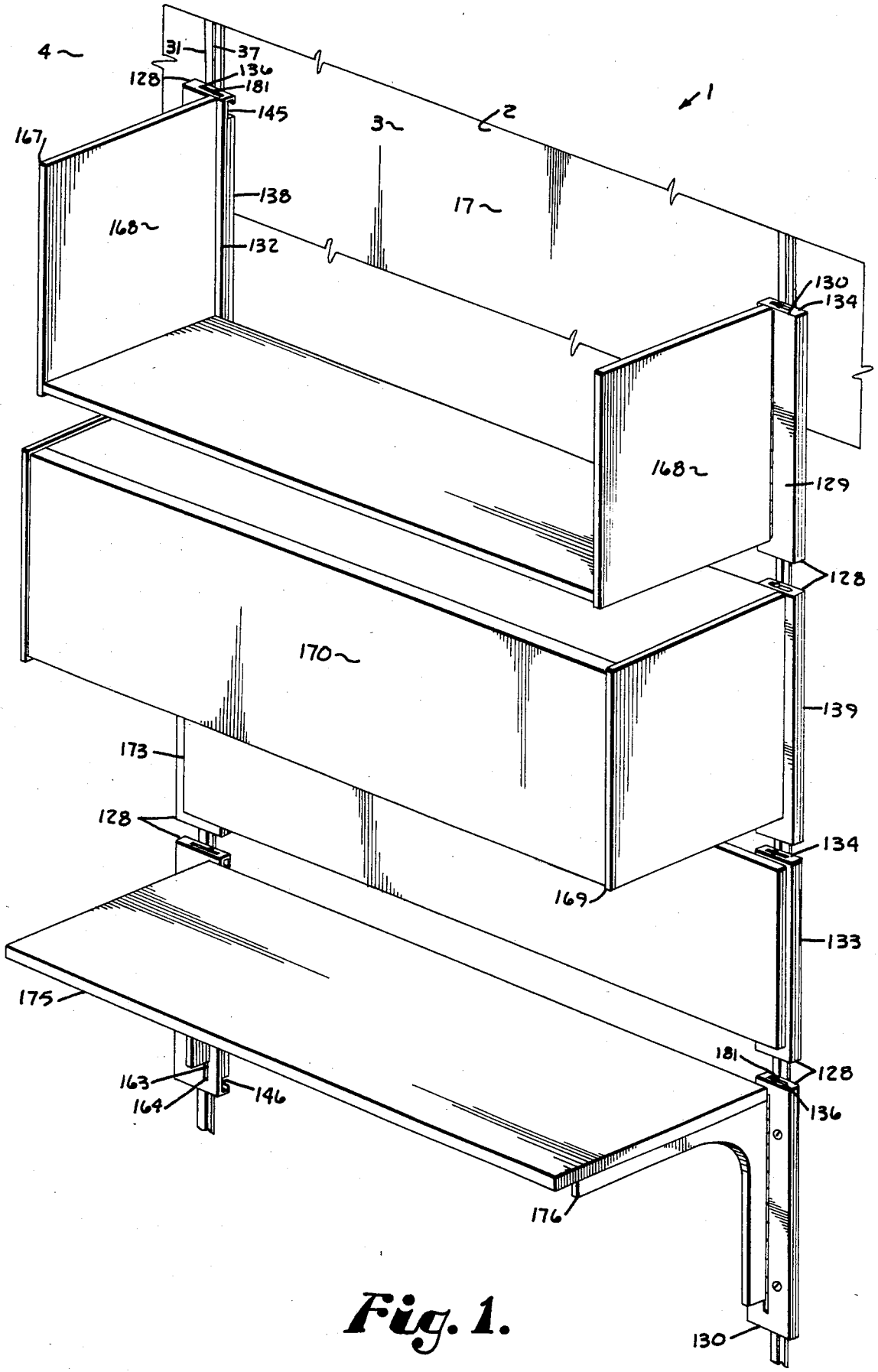
FIG. 1 is a perspective of a prefabricated wall with components mounted thereon with a system embodying the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The terms "in" and "out" and derivatives thereof are used merely for orientation purposes and generally refer to directions into and out of the wall respectively.

Referring to the drawings in more detail, the reference numeral 1 generally designates a component mounting system for a prefabricated wall 2 comprising sections 3. Each section 3 includes a pair of spaced-apart panels 11 forming a wall cavity 12 therebetween. The panels 11 may comprise any suitable material such as gypsum board, hardboard, plywood, etc. A suitable finish material such as vinyl or cloth (not shown) may be applied to the panels 11 or they may simply be painted. Each panel 11 includes a pair of side edges 15 and inner and outer surfaces 16, 17. The wall 2 is constructed by installing a plurality of studs 21 which are spaced slightly further apart on centers than the widths of the panels 11. Each stud 21 includes a pair of flanges 22 interconnected by a web 23. A pair of retainer screw slots 24 are formed at the intersections of the web 23 with each respective flange 22. Each retainer screw slot 24 is open at a respective flange 22.

Figure 2:
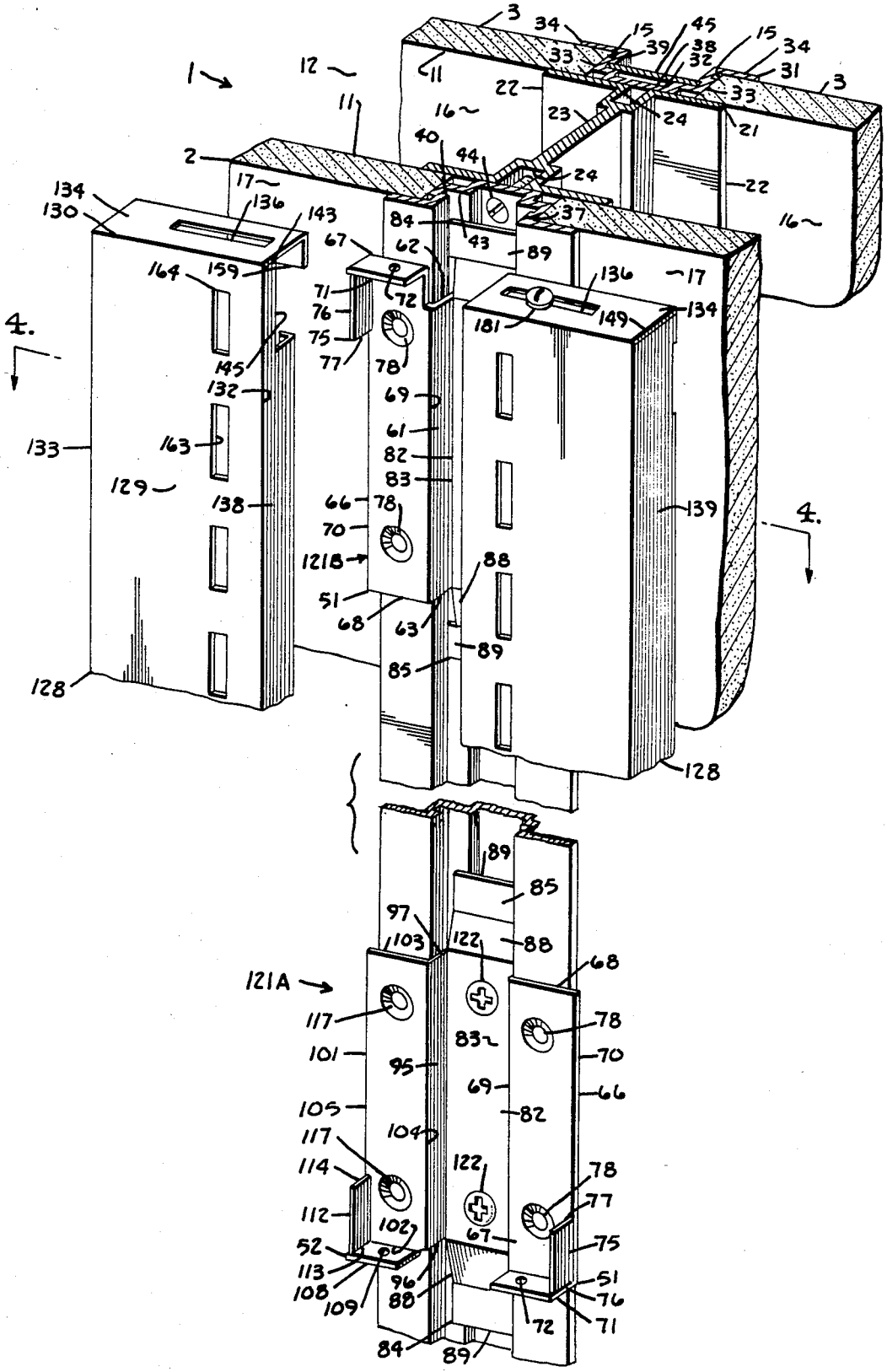
FIG. 2 is a fragmentary, partially exploded perspective of the system, particularly showing upper and lower sets of mounting brackets mounted on the wall.
Figure 3:
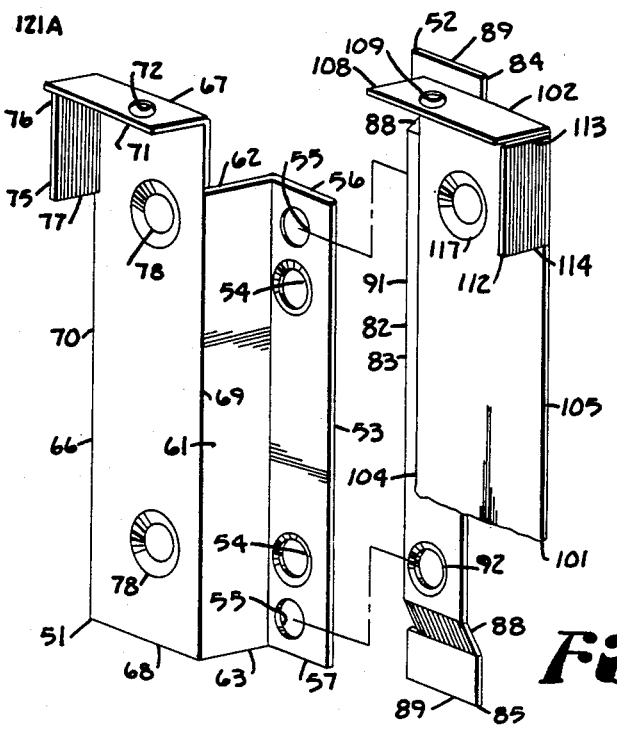
FIG. 3 is a perspective of inner and outer mounting brackets of the system.

As shown in FIG. 2, a pair of retainers 31 are fastened to the stud flanges 22. Each retainer 31 includes an interior middle strip 32 with a pair of legs 33 extending outwardly and laterally therefrom and terminating in a pair of retainer flanges 34. The middle strip 32 and the flanges 34 extend in parallel relation to the panels 11. The middle strip 32 and the legs 33 form a channel 37 which is divided into inner and outer channel portions 38, 39 by a pair of laterally-extending trim slots 40 which are open at the respective retainer legs 33. Each leg 33 forms a respective shoulder 43 adjacent to a respective trim slot 40.

In assembling the wall 2, the panels 11 are placed against the stud flanges 22 with their side edges 15 spaced slightly apart. Retainers 31 are then installed by inserting their legs 33 between respective panel side edges 15. The retainers 31 are secured in position by retainer screws 44 extending through their middle strips 32 and into the retainer screw slots 24. The panels 11 are thus captured at their side edges 15 by respective stud and retainer flanges 22, 34. The retainer screws 44 are concealed by retainer trim pieces 45 which are slid into respective retainer trim slots 40. The trim pieces 45 are ommitted where the mounting system 1 of the present invention is installed.

Inner and outer component mounting brackets 51, 52 are mounted on the retainer 31. The inner component mounting bracket 51 includes an inner leg 53 with countersunk and straight pairs of holes 54, 55 and first and second ends 56, 57. A spacer leg 61 with first and second ends 62, 63 forms a dihedral angle of approximately 90 degrees with the inner leg 53.

An outer leg 66 includes first and second ends 67, 68 and forms a dihedral angle of approximately 90 degrees with the spacer leg 61. The outer leg 66 includes proximate and distal edges 69, 70, the former being located adjacent to the spacer leg 61. The inner bracket leg second ends 57, 63 and 68 are substantially aligned as are the inner and spacer leg first ends 56, 62. The outer leg first end 67 protrudes beyond the inner and spacer leg first ends 56, 62 and terminates in a standard mounting flange 71 with a threaded screw receiver 72. The standard mounting flange 71 is substantially horizontal with the bracket 51 mounted.

A reinforcing flange 75 extends outwardly from the outer leg distal end 70 and includes first and second ends 76, 77. The reinforcing flange first end 76 is substantially aligned with the outer leg first end 67. The reinforcing flange 75 has an overall height equal to approximately twice the distance that the outer leg first end 67 extends beyond the inner and spacer leg first ends 56, 62. Thus, the reinforcing flange 75 extends both above and below the level of the inner and spacer leg first ends 56, 62 and imparts structural rigidity to the outer leg 66. Without the reinforcing flange 75, the outer leg 66 would be far more susceptible to bending, particularly in the area where it intersects with the spacer leg first end 62. A pair of spacer dimples 78 are formed in the outer leg 66 and protude inwardly therefrom in proximity to its proximate edge 69.

The outer component mounting bracket 51 includes an inner leg 82 with a center portion 83 and first and second end portions 84, 85. Each inner leg end portion 84, 85 includes a return 88 extending inwardly frm the center portion 83 forming an obtuse dihedral angle therewith. A respective foot 89 extends from each return 88 and is substantially parallel to the inner leg center portion 83. The feet 89 protrude laterally slightly from a free edge 91 of the center portion 83 and the returns 88. The center portion 83 includes a pair of countersunk holes 92 in proximity to the inner leg end portions 84, 85.

A spacer leg 95 with first and second ends 96, 97 extends outwardly from the inner leg 82 and forms a dihedral angle therewith of approximately 90 degrees. The outer bracket 52 includes an outer leg 101 with first and second ends 102, 103 and proximate and distal edges 104, 105. A standard mounting flange 108 extends outwardly from the outer leg first end 102 and includes a threaded receiver 109.

A reinforcing flange 112 with first and second ends 113, 114 is positioned at levels above and below the spacer leg first end 96 whereby the outer leg 101 is reinforced. A pair of spacer dimples 117 are formed in the outer leg 101 and protrude inwardly therefrom.

The brackeets 51, 52 are adapted for mounting either singly or in sets 121 as required. FIG. 2 shows upper and lower bracket sets **121*a*, 121*b* mounted on the stud 21. Each bracket set 121*a*, 121*b* comprises inner and outer brackets 51, 52. In each set 121*a*, 121*b* the inner bracket 51 is mounted first with screws 122 extending through its countersunk holes 55 and into the retainer screw slot 24. The inner leg 53 is thus drawn tightly against the retainer shoulder 43. The inner leg 82 of the outer mounting bracket 52 is then placed over the inner leg 53 of the inner bracket 51 with the free edge 91 of the former against the spacer leg 61** of the latter.

The outer bracket feet 89 are approximately as wide as the inner bracket inner leg 53 so that they bridge the retainer channel inner portion 38 and engage the retainer shoulders

43. With the outer bracket 52 properly positioned, its inner leg holes 92 align with the straight holes 55 of the inner mounting bracket 51. Screws 122 are inserted through the aligned holes 55, 92 and into the retainer screw slot 24. The outer bracket spacer leg 95 is narrower than the inner bracket spacer leg 95 by aproximately the same distance that the outer bracket inner leg center portion 83 is spaced inwardly from the feet 89. Thus, with the brackets 51, 52 mounted in sets 121, their respective outer legs 66, 101 are substantially coplanar and are positioned in spaced, parallel relation in front of the retainer flanges 34.

The spacer dimples 78, 117 engage the retainer flanges 34 so that standard flange receivers 125 are formed therebetween. The mounting flanges 71, 108 are positioned at the top and bottom of the upper and lower sets **121*a*, 121*b* respectively. The configurations of the brackets 51, 52 are such that each may be used in the upper and lower sets 121*a*, 121*b* by merely reversing their respective orientations. Thus, as shown in FIG. 2, inner mounting brackets 51 are on the left side of upper bracket set 121*a* and on the right side of lower bracket set 121*b*. The outer mounting brackets 52 are likewise located at diagonally opposite corners of the bracket sets 121*a*, 121*b***.

The upper and lower bracket sets **121*a*, 121*b* mount a pair of juxtaposed standards 128. Each standard 128 includes a faceplate 129 with upper and lower ends 130, 131 and proximate and distal side edges 132, 133. Upper and lower end plates 134, 135 with standard mounting screw slots 136 extend inwardly from the faceplate upper and lower ends 130, 131 respectively, and proximate and distal side plates 138, 139 extend inwardly from the faceplate proximate and distal side edges 132, 133** respectively.

The proximate side plate 138 includes upper and lower proximate side openings 145, 146. The distal side plate 139 extends for substantially the full heighth of the standard 128 Proximate and distal side flanges 153, 154 extend from the proximate and distal side plates 138, 139 respectively in opposed relation behind the faceplate 129. Upper and lower end flanges 159, 160 extend from the upper and lower end plates 134, 135 respectively behind the faceplate 129.

Figure 4:
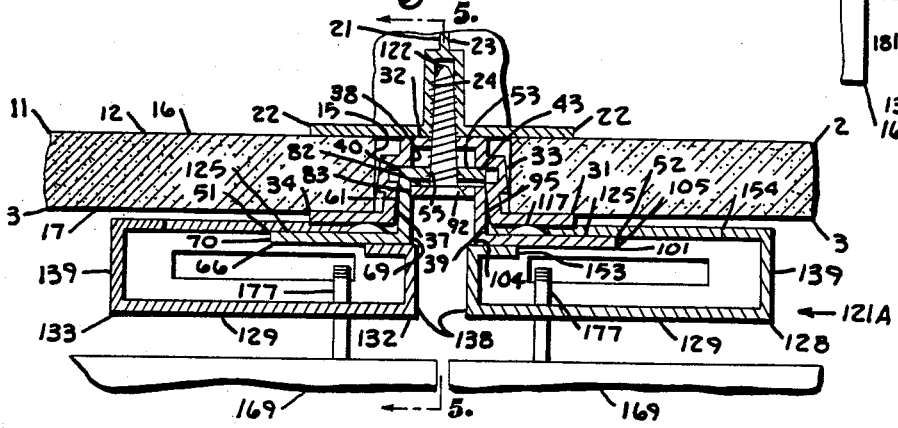
FIG. 4 is a horizontal cross-section of the system taken generally along line 4—4 in FIG. 2.

The proximate side plate and the side flanges 153, 154 terminate in spaced relation from the respective upper and lower end flanges 159, 160. The end plates 134, 135 and the distal side plate 139 are of substantially the same width whereby the distal side flange 154 and the end flanges 159, 160 are substantially coplanar. The proximate side plate 138 is narrower than the end plates 134, 135 and the distal side plate 139 by approximately twice the thickness of the material from which the brackets 51, 52 are formed. Thus, the bracket outer legs 66, 101 are placed against the inside of the proximate side flange 153 and the outside of the end flanges 159, 160 when the standard 128 is mounted (FIG. 4).

Vertically spaced slots 153 extend through the faceplate 129 and are aligned in a column 164 parallel to and in spaced relation from the faceplate edges 132, 133. The column 164 is shown closer to the proximate edge 132 than the distal edge 133 in FIG. 2, but may be located at other positions on the faceplate 129 as shown in FIG. 1.

Figure 5:
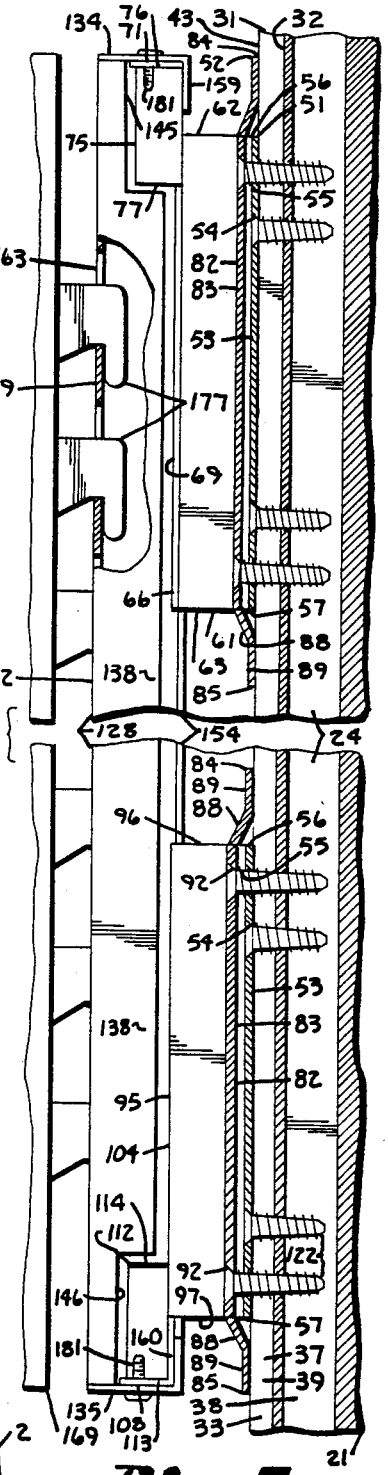
FIG. 5 is a vertical cross-section of the system taken generally along 5—5 in FIG. 4.

FIG. 1 shows a plurality of components comprising a shelf 167 with end panels 168, a storage cabinet with a flip-up type front 170, a bulletin board 173 and a work surface 175 with supports 176. All of the components 167, 169, 173 and 175 includes inwardly-extending hooks or tabs 177 of a type which are well known in the industry. Although plain hooks 177 are shown in FIG. 5, other hooks are available which include locking structure to restrain them in standard slots 163.

In an installation such as that shown in FIG. 1 where none of the components are mounted side-by-side, the brackets 51, 52 may extend from the retainer 31 either in the direction of the component or away from it. In such an application, the standards 128 are also reversible whereby either side plate 138, 139 can be exposed at the side of a respective component. Each component 167, 169, 173 and 176 is mounted on a pair of standards 128, each of which is mounted on an inner bracket 51 and an outer bracket 52, for a total of two standards 128 and four brackets 51, 52 per component. The brackets 51, 52 have opposite orientations so that one of each is required at the top and the bottom to mount a standard 128. In the illustrated embodiment, the inner bracket 51 extends to the left of the retainer 31 when installed at the upper end of a standard 128 and extends to the right of the retainer 31 when istalled at the lower end of a standard 128. Thus, since each component requires four brackets 51, 52, like brackets are positioned diagonally opposite each other.

The components 167, 169, 173 and 175 are shown in FIG. 1 with three different widths to illustrate the situation that might be encountered if they were made by different manufacturers. However, all of them can be mounted on the wall 2 with the mounting system 1 of the present invention. Proper spacing between the slots 163 of the opposite standards 128 is achieved by providing standards 128 which are designed for mounting specific components on specific wall systems and also by laterally adjusting the positions of the standards 128 on respective brackets 51, 52 as is permitted with the standard mounting screw slots 136. With the brackets 51, 52 mounted, each standard 128 is slid on laterally with the standard proximate side openings 145, 146 receiving the mounting flanges 71, 108 and the reinforcing flanges 75, 112 of the brackets 51, 52. The standard proximate side flange 153 is positioned outwardly from the distal side flange 154 and the end flanges 159, 160 so that the bracket outer legs 66, 101 slide behind the standard proximate side flange 153 with the outer leg first ends 67, 102 captured by the standard end flanges 159, 160.

The standard end flanges are received in the standard flange receivers 125. The standard 128 is slid over the brackets 51, 52 until the screw receivers 72, 109 are aligned with the standard mounting screw slots 136, which allow the lateral positioning of the standard 128 relative to the brackets 51, 52 to be adjusted as necessary to achieve the proper spacing of the faceplate slots 163 for mounting a component. When properly positioned, standard mounting screws 181 are inserted through the standard mounting screw slots 136 and are threadedly received in the bracket receivers 72, 109 whereby the standard 128 is clamped to the brackets 51, 52.

For mounting the work surface 175, the attachment of the standards 128 to the wall 2 is preferably reinforced by extending reinforcement screws 184 through the standards 128 and into the studs 121. Alternatively, a reinforcing bar (not shown) may be provided between the brackets 51, 52 and threadedly receive the reinforcement screws 184 when, for example, the standard 128 is not located over the center of a stud 121.

FIGS. 2–5 show the system 1 in a configuration for mounting the components, e.g. storage compartments 169, side-by-side. The inner brackets 151 are first screwed to the retainer 31 and then the outer brackets 52 are installed. The outer bracket screw holes 92 align with the countersunk screw holes 54 of the inner bracket 51. The standards 128 are then slid onto the brackets 51, 52 in the manner described above. The proximate side plates 138 of the standards 128 are in opposed relation. The standard mounting screws slots 136 allow for lateral adjustment of the positions of the standards 128 with respect to the brackets 51, 52.

With the standards 51, 52 thus installed, they are adapted to support the adjacent ends of components, e.g. the storage cabinets 169 shown in FIG. 4, in side-by-side relation.

Without limitation on the generality of useful materials, the brackets 51, 52 and the standards 128 may be stamped from 14 gauge (0.075 inches thick) cold-rolleld steel.

Figure 6:
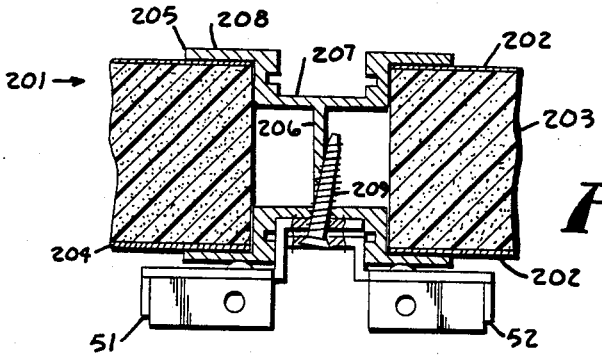
FIG. 6 is a horizontal cross-section of the system embodying the present invention mounted on an alternative type of prefabricated wall.

Shown in FIG. 6 is the component mounting system 1 on another type of prefabricated wall 201. The wall 201 includes hardboard panels 202 laminatd to a corrugated expanded polystyrene core 203. Sections 204 of the wall 201 are joined by studs 205 including webs 206 interconnecting channels 207 from which flanges 208 extend laterally.

The mounting brackets 51, 52 are attached directly to the studs 205 by drilling through the channels 207 and into the webs 206. Upon insertion through the channels 207, mounting screws 209 generally deflect to one side or the other of the webs 206, but are securely anchored within the metal studs 205 for mounting the standards 128 and the components 167, 169, 173 and 175 as described hereinbefore. It is to be understood that while certain forms of the present invention have been illustrated and described herein, it is not to be limited to the specific forms or arrangement of parts described and shown.

What is claimed and desired to be secured by Letters Patent is as follows:

1. A system for mounting a component on a wall and the like, which comprises:

(a) a bracket including:
  (1) attachment means adapted for attaching said bracket to said wall;
  (2) a bracket leg having a reinforcing flange extending outwardly therefrom and adapted to resist a bending load on said bracket; and
  (3) spacer means connected to said attachment means and said bracket leg, said spacer means being adapted to space said bracket leg outwardly from said wall with said bracket attached thereto;

(b) a standard adapted for mounting on said bracket and including:
  (1) a faceplate;
  (2) a second plate extending from said faceplate inwardly toward said wall with said standard mounted on said bracket;
  (3) a flange extending from said second plate; and
  (4) component mounting means adapted for mounting said component on said standard;

(c) said bracket leg defining a standard flange receiver between said bracket leg and said wall, said standard flange receiver being adapted to receive said standard flange with said standard mounted on said bracket and at least a portion of said bracket leg being positioned between said standard faceplate and said standard flange.

2. The system according to claim 1 wherein:

(a) said bracket leg comprises an leg;

(b) said bracket attachment means includes a bracket inner leg adapted for placement against said wall; and (c) said spacer means comprises a spacer leg extending outwardly with respect to said wall from said inner leg to said outer leg.

3. The system according to claim 1, which includes:

(a) said bracket leg having a standard mounting flange extending in a direction thereform outwardly from said wall.

4. The system according to claim 1, which includes:
(a) a standard mounting screw adapted for mounting said standard on said bracket;
(b) said bracket leg including a standard mounting flange at the end thereof with a screw receiver adapted to receive said standard mounting screw;
(c) said standard plate including a screw receiver adapted to receive said standard mounting screw; and
(d) one of said screw receivers being slotted whereby the position of said standard on said bracket may be adjusted laterally.

5. The system according to claim 1 wherein:
(a) said component includes a plurality of hooks extending inwardly with respect to said wall; and
(b) said standard includes a plurality of slots extending through the faceplate thereof, said slots being adapted to receive said hooks whereby said component is mounted on said wall.

6. A system for mounting a component with a plurality of hooks extending therefrom on a wall, the wall including a stud with a web having an outwardly-open retainer screw slot at each end of said web and a retainer with a channel adapted for engaging said stud outwardly of said retainer screw slot and retainer flanges extending laterally from said channel for retaining panels against said stud, which comprises:
(a) an inner mounting bracket including:
(1) an inner leg;
(2) attachment means for attaching said inner leg to said retainer in said channel thereof;
(3) a spacer leg extending outwardly from said inner leg with respect to said wall;
(4) an outer leg with first and second ends and proximate and distal edges, said outer leg being connected to said spacer leg along the proximate edge thereof;
(5) said outer leg having a standard mounting flange connected to said first end thereof and extending outwardly thereform; and
(6) said outer leg having a reinforcing flange extending outwardly from said distal edge adjacent so said first end thereof;
(b) an outer mounting bracket including:
(1) an inner leg adapted to overlie said inner bracket inner leg and having a center portion and first and second and end portions, each of said end portions having a return extending from said center portion inwardly with respect to said wall and a foot connected to said return, said foot being adapted to engage said retainer in said channel thereof;
(2) a spacer leg extending outwardly from said inner leg with respect to said wall; and
(3) an outer leg with first and second ends and proximate and distal edges, said outer leg being connected to said spacer leg along the proximate edge thereof;
(4) said outer leg having a standard mounting flange connected to said first end thereof and extending outwardly therefrom; and
(5) said outer leg having a reinforcing flange extending inwardly from said distal edge adjacent to said first end thereof; and
(c) a standard including:
(1) a faceplate with upper and lower ends and proximate and distal edges;
(2) upper and lower end plates extending inwardly from said faceplate upper and lower ends;
(3) proximate and distal side plates extending inwardly from said faceplate along said proximate and distal edges respectively;
(4) upper and lower proximate side openings formed in said proximate side plate adjacent said faceplate upper and lower ends respectively;
(5) upper and lower end flanges extending downwardly and upwardly respectively from said upper and lower end plates;
(6) said standard being adapted for mounting on said brackets by inserting said bracket mounting flanges and reinforcing flanges through respective proximate side openings with said bracket outer leg ends positioned between said faceplate and said standard upper and lower end flanges respectively; and
(7) a plurality of slots in said faceplate adapted to receive said component hooks.

7. The system according to claim 6, which includes:
(a) a pair of standard mounting screws;
(b) each said bracket standard mounting flange having a threaded screw receiver;
(c) each said standard end plate having a screw receiver slot extending laterally with respect thereto; and
(d) said standard being mounted on said brackets by inserting said screws through said screw receiver slots and into said screw receivers, said screw reciver slots permitting lateral adjustment of the position of said standard on said brackets.

8. A system for mounting a component on a wall and the like, which comprises:
(a) a bracket including:
(1) an inner leg adapted for attachment to said wall;
(2) a spacer leg extending outwardly from said inner leg with respect to said wall;
(3) an outer leg extending laterally from said spacer leg and including a bracket end, said bracket outer leg being positioned in spaced relation from said wall with said bracket attached thereto whereby a standard flange receiver is defined therebetween; and
(4) a standard mounting flange at said bracket end;
(b) means for attaching said bracket to said wall;
(c) a standard including an inner flange received in said standard flange receiver with said standard mounted on said bracket and an end plate adapted for engagement with said standard mounting flange;
(d) each of said standard mounting flange and said standard end plate having a screw receiver adapted to receive a standard mounting screw; and
(e) means for attaching said component to said standard.

9. The system according to claim 8 wherein:
(a) one of said screw receivers comprises a slot which extends laterally with respect to said standard with said standard mounted on said bracket, said slot allowing the position of said standard with respect to said bracket to be adjusted laterally.

10. A system for mounting a component on a wall and the like, which comprises:
(a) a bracket including:
(1) an outer leg;
(2) an inner leg adapted for placement against said wall whereby said bracket is attached thereto;

(3) a spacer leg extending outwardly with respect to said wall from said inner leg to said outer leg;
(4) each of said bracket legs having an end;
(5) the outer leg end extending beyond the ends of said inner and spacer legs;
(6) said outer leg including a reinforcing flange extending from said outer leg end to a level beyond said inner and spacer leg ends; and
(7) a standard mounting flange extending from said outer leg end;

(b) a standard adapted for mounting on said bracket and including:
(1) a faceplate;
(2) a second plate extending from said faceplate inwardly towards said wall with said standard mounted on said bracket;
(3) a flange extending from said second plate; and
(4) component mounting means adapted for mounting said component on said standard; and (c) said bracket leg defining a standard flange receiver between said bracket leg and said wall, said standard flange receiver being adapted to receive said standard flange with said standard mounted on said bracket and at least a portion of said bracket leg being positioned between said standard faceplate and said standard flange.

11. The system according to claim 10 wherein:
(a) said standard second plate comprises an end plate extending from an end of said standard; and
(b) said standard includes a side plate extending inwardly from said standard faceplate with said standard mounted on said brfacket and said bracket mounted on said wall, said standard side plate having an opening adapted to receive said standard mounting flange and said reinforcing flange.

12. A system for mounting a component and a wall and the like, which comprises:
(a) an inner bracket including:
(1) an outer leg;
(2) an inner leg adapted for placement against said wall whereby said bracket is attached thereto; and
(3) a spacer leg extending outwardly with respect to said wall from said inner leg to said outer leg, said spacer leg being adapted to space said outer leg outwardly from said wall with said bracket attached thereto;

(b) an outer bracket having:
(1) an inner leg adapted to overlie said inner bracket inner leg;
(2) a spacer leg extending outwardly from said inner leg with respect to said wall; and
(3) an outer leg extending from said spacer leg;

(c) said inner and outer bracket outer legs being substantially coplanar with said brackets mounted on said wall;
(d) a standard adapted for mounting on one of said brackets and including:
(1) a faceplate;
(2) a second plate extending from said faceplate inwardly toward said wall with said standard mounted on said one bracket;
(3) a flange extending from said second plate; and
(4) component mounting means adapted for mounting said component on said standard; and (e) said one bracket outer leg defining a standard flange receiver between said one bracket outer leg and said wall, said standard flange receiver being adapted to receive said standard flange with said standard mounted on said one bracket and at least a portion of said one bracket outer leg being positioned between said standard faceplate and said standard flange.

13. The system according to claim 12, which includes:
(a) said outer bracket inner leg having a center portion and first and second end portions, each of said end portions having a return extending from said center portion inwardly with respect to said wall and a foot connected to said return and adapted for engaging said wall with said outer bracket mounted thereon.

14. The system according to claim 12 wherein:
(a) said inner bracket inner leg is positioned between said outer bracket inner leg end portions and between said outer bracket inner leg and said wall with said brackets mounted on said wall.

15. The system according to claim 12 wherein said standard includes:
(a) a pair of ends;
(b) a pair of end plates, one of which comprises said second plate, extending from said faceplate toward said wall at said ends;
(c) a pair of said standard flanges each extending from a respective said end plate; and
(d) said standard being mounted on said wall by inner and outer brackets positioned at the ends thereof, each of said bracket outer legs defining a standard flange receiver between said bracket outer leg and said wall, said standard flange receivers being adapted to receive said standard flanges with said standard mounted on said brackets and at least a portion of each said bracket outer leg positioned between said standard faceplate and a respective standard flange.

16. The system according to claim 12 wherein:
(a) said component is mounted on a pair of said standards, each of said standards being mounted on respective inner and outer brackets at its ends.

17. The system according to claim 12 wherein:
(a) said wall includes a pair of spaced, vertically-extending channels; and
(b) said brackets are adapted for mounting on said wall with said inner legs thereof received in said channel.

18. The system according to claim 17 which includes:
(a) said wall including a screw-receiving slot accessible through said channel; and
(b) screws extending through said bracket inner legs and into said slot.

19. The system according to claim 12 which includes:
(a) said bracket attachment means comprising a fastener adapted to extend through said overlying bracket inner legs and into said wall.

20. The system according to claim 12 wherein:
(a) upper and lower sets of said brackets are mounted on said wall, each of said sets including an inner and an outer bracket; and
(b) a pair of said standards are mounted on said bracket sets in juxtaposed relation, each of said standards being mounted on a respective inner and outer bracket at its opposite ends.

21. A system for mounting a component on a wall and the like, which comprises:
(a) a bracket including:

(1) attachment means adapted for attaching said bracket to said wall;

(2) a bracket leg having a standard mounting flange extending in a direction outwardly from said wall; and (3) spacer means connected to said attachment means and said bracket leg, said spacer means being adapted to space said bracket leg outwardly from said wall with said bracket attached thereto;

(b) a standard adapted for mounting on said bracket including:

(1) a faceplate;

(2) a second plate extending from said faceplate inwardly toward said wall with said standard mounted on said bracket and connected to said standard mounting flange whereby said standard is at least partly supported on said standard second plate;

(3) a flange extending from said second plate; and (4) component mounting means adapted for mounting said component on said standard; and (c) said bracket leg defining a standard flange receiver between said bracket leg and said wall, said standard flange receiver being adapted to receive said standard flange with said standard mounted on said bracket and at least a portion of said bracket leg being positioned between said standard faceplate and said standard flange.

22. A system for mounting a component on a wall and the like, which comprises:

(a) an inner bracket including:

(1) an inner leg adapted for attachment to said wall;

(2) an outer leg; and (3) spacer means connected to said inner and outer legs and adapted to space said outer leg outwardly from said wall with said bracket attached thereto;

(b) an outer bracket including:

(1) an inner leg adapted for placement over said inner bracket inner leg;

(2) an outer leg; and (3) spacer means connected to said inner and outer legs and adapted to space said outer leg outwardly from said wall with said bracket attached thereto; and (c) a pair of standards each adapted for mounting on a respective bracket and including:

(1) an inner flange adapted for positioning inwardly of said bracket outer leg; and (2) means for attaching said component to said wall.

* * * * *